US007434517B1

(12) United States Patent
Linker

(10) Patent No.: US 7,434,517 B1
(45) Date of Patent: Oct. 14, 2008

(54) STUN GUN DART HAVING A RETRACTABLE SPEAR

(76) Inventor: Carson R. Linker, 9515 NE. 312th Ave., Camas, WA (US) 98607

( * ) Notice: Subject to any disclaimer, the term of this patent is extended or adjusted under 35 U.S.C. 154(b) by 154 days.

(21) Appl. No.: 11/269,014

(22) Filed: Nov. 8, 2005

(51) Int. Cl.
*F42B 12/00* (2006.01)
*F42B 30/00* (2006.01)
*F41B 15/04* (2006.01)

(52) U.S. Cl. ..... 102/502; 42/1.08; 361/232

(58) Field of Classification Search ..... 42/1.08; 361/232; 102/504, 512, 502
See application file for complete search history.

(56) References Cited

U.S. PATENT DOCUMENTS

| | | | | |
|---|---|---|---|---|
| 1,381,683 | A | 6/1921 | Weinbeer | |
| 1,807,347 | A | 5/1931 | Schweigert | |
| 4,735,612 | A * | 4/1988 | Chevalier | 604/130 |
| 4,863,428 | A | 9/1989 | Chevalier | 604/130 |
| 5,467,247 | A * | 11/1995 | de Anda et al. | 361/232 |
| 5,526,719 | A | 6/1996 | Chen | 81/25 |
| 5,747,719 | A * | 5/1998 | Bottesch | 89/1.1 |
| 5,833,715 | A * | 11/1998 | Vachon et al. | 607/120 |
| 5,962,806 | A * | 10/1999 | Coakley et al. | 102/502 |
| 6,091,597 | A * | 7/2000 | Lin | 361/232 |
| 6,148,492 | A | 11/2000 | Gaulden | 29/264 |
| 6,196,979 | B1 * | 3/2001 | Virtanen | 600/573 |
| 6,595,655 | B2 * | 7/2003 | Neeb | 362/154 |
| 6,767,003 | B1 | 7/2004 | Toensing | 254/25 |
| 6,807,762 | B1 * | 10/2004 | Edwards | 42/1.08 |
| 6,896,670 | B2 | 5/2005 | Cherif Cheikh | 604/506 |
| 7,076,903 | B2 * | 7/2006 | Edwards | 42/70.08 |
| 2001/0037072 | A1 * | 11/2001 | Virtanen | 600/573 |
| 2003/0072148 | A1 * | 4/2003 | Neeb | 362/154 |
| 2005/0044768 | A1 * | 3/2005 | Edwards | 42/1.08 |

* cited by examiner

*Primary Examiner*—Bret Hayes
(74) *Attorney, Agent, or Firm*—Timothy E. Siegel Patent Law, PLLC

(57) ABSTRACT

A stun gun dart includes a base, having an interior cavity, an energy storage assembly and an actuator. Also, a spear is supported by the base and the actuator, when actuated, causes the energy storage assembly to retract the spear into the cavity. In a preferred embodiment a conductive wire extends through the base and is electrically connected to the spear.

10 Claims, 1 Drawing Sheet

STUN GUN DART HAVING A RETRACTABLE SPEAR

BACKGROUND OF THE INVENTION

The proliferation of stun guns among law enforcement, security forces and facilities for holding large animals throughout the world, has caused an unanticipated problem. Stun guns, such as the Taser® gun, work by shooting barbed darts into the subject. These darts are connected to thin wires, through which a series electric pulses is passed to pacify the subject.

After the subject has been subdued, it is necessary for a responding professional to remove the dart(s) from the subject. This is typically done by holding the subject down with one hand, while removing the dart with the other. Unfortunately, during this operation the subject may suddenly move in an effort to gain freedom. This, in turn, may throw the responding professional off balance to the point that he inadvertently jabs the barbed end of the newly removed dart into the hand used to stabilize the body part that had received the dart.

Far from being a minor, temporary injury, this brief event may have a life-long and tragically life-shortening effect on the responding professional, who may contract hepatitis, HIV or any one out of a long list of blood born pathogens from blood on the dart. This very occurrence has become all too common, with thousands of people all infected with a deadly virus through this mechanism or a related cause, such as an intra venous needle stick. Some way must be found to make the removal of stun gun darts safer for the personnel who must remove them from the subjects.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In a first separate aspect the present invention takes the form of a stun gun dart that includes a base, having an interior cavity, an energy storage assembly and an actuator. Also, a spear is supported by the base and the actuator, when actuated, causes the energy storage assembly to retract the spear into the cavity.

In a second separate aspect the present invention takes the form of a stun gun dart a spear and a base supporting the spear and having means to retract the spear into the base and means to retain the spear within the base. The stun gun dart also includes means for actuating the means to retract the spear into the base.

In a third separate aspect the present invention takes the form of a method of deploying a stun gun dart against a suspect, and of subsequently safely retrieving the dart. The method uses a stun gun dart having a base and retractable spear and an actuator adapted to cause the spear to retract into the base. This stun gun dart is fired from a stun gun at a suspect. Later, a method performer actuates the actuator to retract the spear and retrieves the dart.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION OF THE PREFERRED EMBODIMENT(S)

Figure 1:
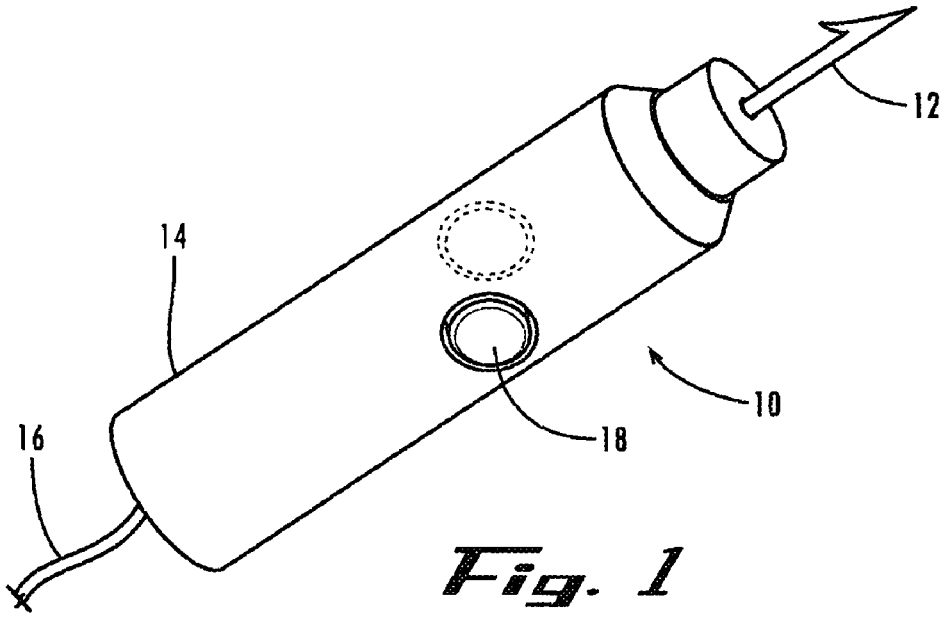
FIG. 1 is a perspective view of a stun gun dart, according to the present invention.

Referring to FIG. 1, a stun gun dart 10 according to a preferred embodiment of the present invention includes a spear 12, a base 14 and a conductive wire 16, which is electrically connected to spear 12 so that a public safety officer may give a jolt of electricity to a suspect by way of spear 12.

Figure 2:
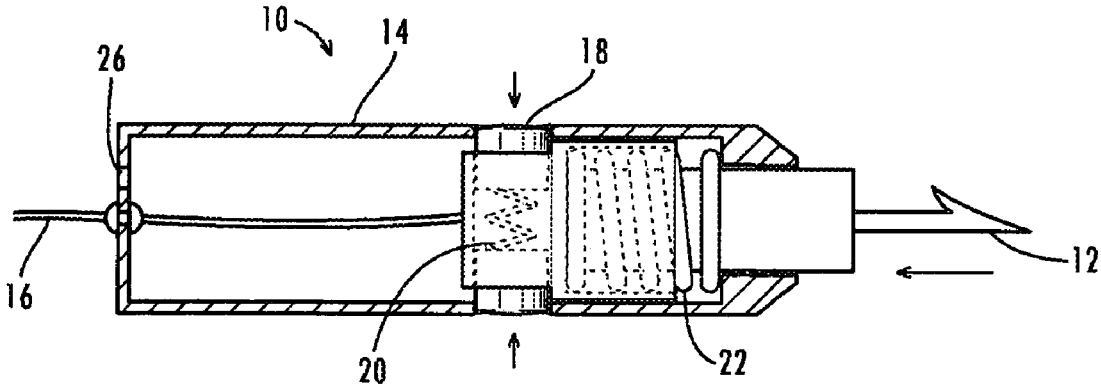
FIG. 2 is side sectional view of the stun gun dart of FIG. 1.
Figure 3:
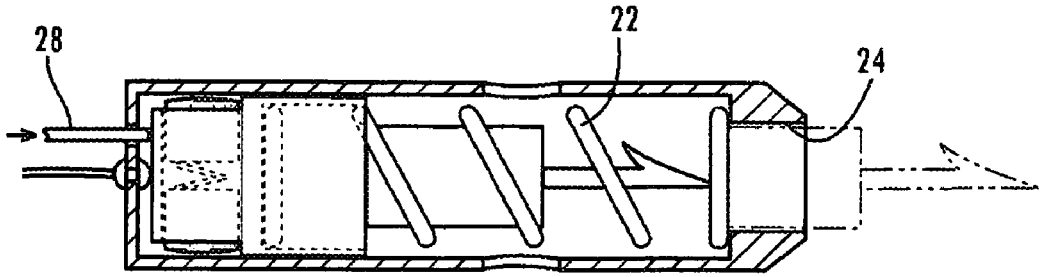
FIG. 3 is a side sectional view of the stun gun dart of FIG. 1, showing the spear retracted.

Referring now to FIG. 2, a pair of buttons 18 may be pressed, thereby compressing spring 20, until the sides of buttons 18 clear the side wall that defines base 14. At this point the side wall of base 14 no longer constrains spring 22, by way of buttons 18, and spring 22 pushes buttons 18, spring 20 and spear 12 in a rearward manner. Accordingly, the spear 12 is no longer a threat to the public safety officer. In one preferred embodiment there are wide cone or dome shaped projections on buttons 18 to help a user depress buttons 18 far enough so that they clear the side wall of base 14. Alternatively, a user could use a tool to depress buttons 18.

In one preferred embodiment, a cap (not shown) is provided which locks into place in opening 24 at the front of base 14, providing enhanced safety. An opening 26 permits spear 12 pushed into place by way of a push rod 28. This would allow darts to be stored with spear 12 retracted and placed into a ready state with the spear 12 deployed, directly before it is used. In an alternative preferred embodiment opening 26 is omitted.

In use, dart 10 is shot from a stun gun, typically along with at least one other dart 10. An electric current is pulsed through the suspect who has received the darts, typically with one dart charged positive and the other dart charged negative or grounded.

After the suspect has been subdued a public safety officer approaches to remove the darts 10 and further restrain the suspect. To remove the darts 10, the officer presses inwardly on buttons 18, causing spear 12 to retract. The retraction of spear 12 should pull spear 12 out of the suspect's body. If it does not, spear 12 will retract as soon as the officer has disengaged from the suspects body.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A stun gun dart, comprising:

(a) a base, having an interior cavity, a spring and an actuator;

(b) a spear, supported by said base; and (c) wherein said actuator is connected to a catch that restrains said spring and which releases said spring when said actuator is actuated, thereby causing said spring to retract said spear into said cavity.

2. The stun gun dart of claim 1, wherein said spring is a coil spring.

3. The stun gun dart of claim 1, wherein said actuator includes at least one button.

4. The stun gun dart of claim 3, wherein said actuator includes at least one additional button.

5. The stun gun dart of claim 1, in which an electrically conductive wire extends from said base of said dart and is electrically connected to said spear.

6. A stun gun dart, comprising:

(a) a spear;

(b) a base supporting said spear and having spring means to retract said spear into said base and means to retain said spear within said base; and (c) means for actuating that are connected to a catch for restraining said spring means and which releases said spring means when said means for actuating are actuated, thereby retracting said spear into said base.

7. The stun gun dart of claim 6, wherein said spring means take the form of a coil spring.

8. The stun gun dart of claim 6, wherein said means for actuating includes at least one button.

9. The stun gun dart of claim 8, wherein said means for actuating includes at least one additional button.

10. The stun gun dart of claim 6, in which an electrically conductive wire extends from said base of said dart and is electrically connected to said spear.

* * * * *